US006339373B1

(12) United States Patent
Zeskind et al.

(10) Patent No.: US 6,339,373 B1
(45) Date of Patent: Jan. 15, 2002

(54) SENSOR DEVICE PROVIDING INDICATION OF DEVICE HEALTH

(76) Inventors: Dale A. Zeskind, 14 Hickory Hill Rd., Wayland, MA (US) 01778; Dennis Lonigro, 92 Anne Rd., Norwood, MA (US) 02062; Donald Smith, 21 Abenaki Rd., Northboro, MA (US) 01532

( * ) Notice: Subject to any disclaimer, the term of this patent is extended or adjusted under 35 U.S.C. 154(b) by 0 days.

(21) Appl. No.: 09/290,298

(22) Filed: Apr. 13, 1999

Related U.S. Application Data

(60) Provisional application No. 60/083,946, filed on May 1, 1998.

(51) Int. Cl.[7] ..... G08B 1/08

(52) U.S. Cl. ..... 340/534; 340/506; 340/825.06; 340/825.16; 340/825.36; 340/825.49

(58) Field of Search ..... 340/506, 526, 340/534, 679, 825.06, 825.16, 825.17, 825.36, 825.49

(56) References Cited

U.S. PATENT DOCUMENTS 4,363,030 A 12/1982 Maltby et al. ..... 340/511
4,414,539 A 11/1983 Armer ..... 340/500
4,555,695 A 11/1985 Machida et al. ..... 340/538
4,575,718 A 3/1986 Ludowyk ..... 340/825.17
4,924,418 A 5/1990 Bachman et al. ..... 364/550
5,138,562 A 8/1992 Shaw et al. ..... 364/550
5,689,229 A * 11/1997 Chaco et al. ..... 340/286.07
5,793,288 A * 8/1998 Peterson et al. ..... 340/567
6,002,338 A * 12/1999 Pavlov et al. ..... 340/635

* cited by examiner

*Primary Examiner*—Daryl Pope

(57) ABSTRACT

A sensor device is provided for sensing a selected parameter such as pressure or temperature at a selected site, which is typically a remote site, and for generating outputs, normally to a control site, which outputs are either selected steady state or non-steady state outputs, the non-steady state outputs being indicative of the parameter being within a normal or acceptable range and/or the parameter being within an unacceptable or alarm range. The steady state outputs can be indicative either of the parameter being within a normal range or of a device failure. A particular steady state output, for example a null output, may be indicative of all failure conditions or different steady state outputs may be utilized to indicate different failure conditions.

22 Claims, 6 Drawing Sheets

High Limit Alarm SW1 turns ON above SETPOINT, & OFF reaching SETPOINT minus the DEADBAND.

| SETTING | SW1 | IAW | LED | LCD | PRESSURE | | LCD | SW1 | IAW | LED |
|---|---|---|---|---|---|---|---|---|---|---|
| Overrange | ON | Flash | Flash | C | ↑ | ↓ | C | ON | Flash | Flash |
| Above Setpoint | ON | Flash | Flash | B | ↑ | ↓ | B | ON | Flash | Flash |
| SETPOINT (SP) | OFF | ON | ON | A | ↑ | ↓ | B | ON | Flash | Flash |
| Deadband (DB) | OFF | ON | ON | A | ↑ | ↓ | B | ON | Flash | Flash |
| Setpoint-Deadband | OFF | ON | ON | A | ↑ | ↓ | A | OFF | ON | ON |
| Below SP-DB | OFF | ON | ON | A | ↑ | ↓ | A | OFF | ON | ON |
| Underrange | OFF | ON | ON | E | ↑ | ↓ | E | OFF | ON | ON |
| FAILURE | | OFF | | | | | | | OFF | |

High Limit Shutdown SW1 turns OFF above SETPOINT, & ON reaching SETPOINT minus the DEADBAND.

| SETTING | SW1 | IAW | LED | LCD | PRESSURE | | LCD | SW1 | IAW | LED |
|---|---|---|---|---|---|---|---|---|---|---|
| Overrange | OFF | Flash | Flash | C | ↑ | ↓ | C | OFF | Flash | Flash |
| Above Setpoint | OFF | Flash | Flash | B | ↑ | ↓ | B | OFF | Flash | Flash |
| SETPOINT (SP) | ON | ON | ON | A | ↑ | ↓ | B | OFF | Flash | Flash |
| Deadband (DB) | ON | ON | ON | A | ↑ | ↓ | B | OFF | Flash | Flash |
| Setpoint-Deadband | ON | ON | ON | A | ↑ | ↓ | A | ON | ON | ON |
| Below SP-DB | ON | ON | ON | A | ↑ | ↓ | A | ON | ON | ON |
| Underrange | ON | ON | ON | E | ↑ | ↓ | E | ON | ON | ON |
| FAILURE | | OFF | | | | | | | OFF | |

Low Limit Alarm SW1 turns ON below SETPOINT, & OFF reaching SETPOINT plus the DEADBAND.

| SETTING | SW1 | IAW | LED | LCD | PRESSURE | | LCD | SW1 | IAW | LED |
|---|---|---|---|---|---|---|---|---|---|---|
| Overrange | OFF | Flash | Flash | C | ↓ | ↑ | C | OFF | Flash | Flash |
| Above SP+DB | OFF | ON | ON | A | ↓ | ↑ | A | OFF | ON | ON |
| Setpoint+Deadband | OFF | ON | ON | A | ↓ | ↑ | A | OFF | ON | ON |
| Deadband (DB) | OFF | ON | ON | A | ↓ | ↑ | D | ON | Flash | Flash |
| SETPOINT (SP) | OFF | ON | ON | A | ↓ | ↑ | D | ON | Flash | Flash |
| Below SP | ON | Flash | Flash | D | ↓ | ↑ | D | ON | Flash | Flash |
| Underrange | ON | Flash | Flash | E | ↓ | ↑ | E | ON | Flash | Flash |
| FAILURE | | OFF | | | | | | | OFF | |

Low Limit Shutdown SW1 turns OFF below SETPOINT, & ON reaching SETPOINT plus the DEADBAND.

| SETTING | SW1 | IAW | LED | LCD | PRESSURE | | LCD | SW1 | IAW | LED |
|---|---|---|---|---|---|---|---|---|---|---|
| Overrange | ON | Flash | Flash | C | ↓ | ↑ | C | ON | Flash | Flash |
| Above SP+DB | ON | ON | ON | A | ↓ | ↑ | A | ON | ON | ON |
| Setpoint+Deadband | ON | ON | ON | A | ↓ | ↑ | A | ON | ON | ON |
| Deadband (DB) | ON | ON | ON | A | ↓ | ↑ | D | OFF | Flash | Flash |
| SETPOINT (SP) | ON | ON | ON | A | ↓ | ↑ | D | OFF | Flash | Flash |
| Below SP | OFF | Flash | Flash | D | ↓ | ↑ | D | OFF | Flash | Flash |
| Underrange | OFF | Flash | Flash | E | ↓ | ↑ | E | OFF | Flash | Flash |
| FAILURE | | OFF | | | | | | | OFF | |

Display codes: A = Process pressure (top line) and bargraph (bottom line).
B = Process pressure and VALUE>SETPOINT cycled w/bargraph
C = Flashing OVERRANGE !
D = Process pressure and VALUE<SETPOINT cycled w/bargraph
E = Flashing UNDERRANGE !

Fig. 7

SENSOR DEVICE PROVIDING INDICATION OF DEVICE HEALTH

RELATED APPLICATIONS

This application claims priority from provisional specification No. 60/083946 filed May 1, 1998, the subject matter of which is incorporated herein by reference.

FIELD OF THE INVENTION

This invention relates to sensor devices for detecting a parameter at a selected site, for outputting an indication as to whether the selected parameter is within an accepted range and for generating, on the same line, an indication as to the "health" of the sensor device.

BACKGROUND OF THE INVENTION

There are many applications where temperature, pressure, vibration or some other parameter of equipment, of a conduit containing a flowing gas, liquid or other fluid, a tank or other stationary fluid container, or some other element at a selected site must be monitored and certain action taken if the sensed parameter is determined to be outside of a selected range. Further, since the site where such monitoring is being performed may be hazardous or difficult to reach, it is desirable that information about the parameter being monitored at the site be transmitted to a central control station and that the station also receive an indication if there is a malfunction or failure at the sensor device so that remedial action may be taken.

Heretofore, some available devices have been relatively simple and inexpensive, but have not had the capability of providing a self-diagnostic indication of device health, have provided limited flexibility in adjusting parameters, doing maintenance checks and the like, and have not been adapted for remote readout. At the other end of the spectrum have been smart digital transmitters which enable remote sensing and process monitoring. These solid state devices, having no moving parts, are generally more accurate, flexible and reliable, and have more complex communication capability, but are also far more complex and costly. Other available devices suffer from similar problems.

A need therefore exists for a relatively simple and reliable sensor device which can provide critical information with minimal complexity to a remote site, preferably over a single wire pair. This information would include both important status of the selected parameter and reliable self-diagnostic indication of the sensor device health. This is particularly important in hazardous environments so that a problem or potential problem does not go undetected because of a defect in the sensor device performing monitoring of a parameter at the particular site.

SUMMARY OF THE INVENTION

In accordance with the above, this invention provides a sensor device which includes a sensor for detecting a selected parameter, such as pressure or temperature at a selected site. The device also includes a controller which receives indications from the sensor of the condition, or value, of the selected parameter. The controller then generates a selected steady state signal, or a non-steady state signal, for example a pulse signal, when the sensed parameter is within a first range, for example an acceptable or normal range, and generates the other of the signals when the parameter is in a second range, for example an unacceptable or alarm range.

For preferred embodiments, the steady state signal is generated when the parameter is within an acceptable or normal range and the non-steady state, or pulse signal, when the parameter is in an unacceptable or alarm range. There may also be at least one additional unacceptable range beyond the initial unacceptable range, each of which results in the controller generating a different non-steady state signal, for example a higher, or lower, frequency pulse signal. In addition, the controller generates a null output, i.e., no output (open), when the parameter value being sensed is beyond the range of the sensor (an overrange or underrange value), or where there is a defect in the sensor device, including a malfunction of the sensor, a plugged process port leading to the sensor, a controller malfunction, a loss of power at the sensor device, a cut or break in the signal line from the sensor device, a device switch malfunction or some other failure condition. The controller may provide for a deadband where the first and second ranges overlap, and where the controller continues to generate the signal it is generating when in the deadband region. This serves to reduce ambiguity about the selected parameter status.

For a preferred embodiment, the controller includes a watchdog timer which continues to generate a pulsed output only if it receives refresh signals from the controller at selected time intervals. The controller is designed so that it stops providing refresh signals to the watchdog timer in response to selected error conditions at the device. Thus, if there is a loss of power or the controller is malfunctioning, it will stop generating resets to the watchdog timer. When there is no pulsed output from the watchdog timer, the controller generates a null output indicating a sensor device malfunction. The controller is also programmed to generate a null output on the detection of other error conditions, such as a faulty sensor, a plugged process sensor port, a controller output error, a switch failure or the like.

The parameter being detected by the sensor normally has at least slight variations with time as a result for example of flow turbulence, variations in ambient temperature, humidity, and the like, and variations in electrical source, etc. The controller can monitor variations in parameters received from the sensor and can generate null outputs in response to the sensor not conforming to a predetermined profile. For example, if the output from the sensor remains substantially constant for a selected time interval, this may be an indication that either the sensor is malfunctioning or that the process sensor port is plugged. For a particular application, other variations in the profile of the sensor outputs over a given time interval may be indicative of other error conditions which the controller can be programmed to recognize and respond to. The device can also operate in a "learn mode" wherein operation under normal conditions are monitored for selected time periods and utilized to create an application profile. This self learning mode could be used for, but is not limited to, learning the profile of a continuous or changing process. It could then use this self-learned profile to monitor parameters for acceptable and non-conforming performance and provide the appropriate status indication. An example might be to learn a parameter's profile conditions for day or evening process operation.

To further assure proper operation of the device, the output from the controller to a control element switch may loop back to a controller input to be compared against the desired generated output. Any difference in the desired generated output and the looped or fed back output signal is indicative of a device malfunction and can result in a null or other failure output from the controller. The switch is operated in response to the controller detecting the sensed parameter being in the second or unacceptable range. The switch output can then be used to control an alarm or shutdown indicator or operate a suitable control element to restore the parameter to the first or desired range. Such a control element might for example be a valve to increase or decrease pressure, or a thermoelectric element to heat or cool the monitored parameter as appropriate. Depending on the parameter sensed, other suitable controls might also be employed. Where an additional range is recognized by the controller, operation in this range may result in an automatic shutdown of at least relevant portions of the monitored system or initiate other appropriate action.

The device also includes an output line or line pair (mode/health line) from the device to which the steady state signal, non-steady state signal, and the null or other failure output are applied. Where a control element such as a valve is operated, this separate output from the device is provided to indicate the state of such control element as well as information about the sensor device health.

An alternative embodiment, this output (mode/health) line uses four, or more, signal states to indicate two, or more, operating range conditions and two, or more, classes of fault or failure conditions. In this embodiment, the controller generates a non-steady state output signal of one frequency (or duty cycle) when the selected parameter is in an acceptable range and a second frequency (or duty cycle) signal when the selected parameter is in an unacceptable range. A constant "on" steady state output signal indicates one class of fault conditions, such as a grounded or shorted connection, and a null or "open" output signal indicates a variety of other fault conditions such as a sensor device defect, sensor malfunction, plugged port, watchdog time-out, loss of power, broken signal line, output switch malfunction, etc.

The foregoing and other objects, features and advantages of the invention will be apparent from the following more particular description of a preferred embodiment as illustrated in the accompanying drawings.

IN THE DRAWINGS

FIG. 7 is a chart illustrating device operation under various conditions for a pressure sensor/switch of the embodiment illustrated by FIG. 5.

DETAILED DESCRIPTION

Figure 1:
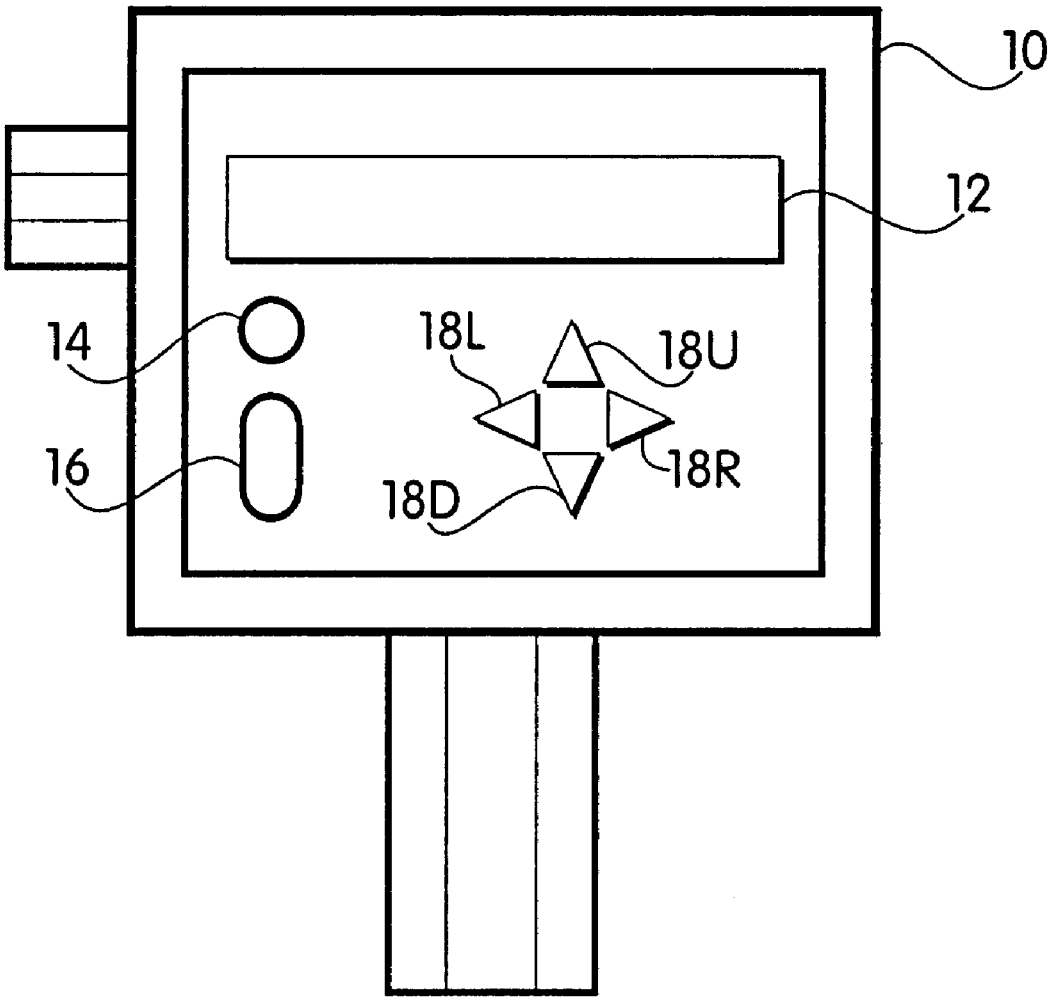
FIG. 1 is a diagrammatic front view of an enclosure configuration suitable for use in practicing the teachings of this invention.

FIG. 1 shows the enclosure for a device 10 suitable for practicing the teachings of this invention. The device has a display 12, for example a liquid crystal display, a switch state or mode/health indicator 14 which may for example be a light-emitting diode (LED), an infrared I/O unit 16 which may be used for calibrating and loading information into the device and four arrow keys 18, namely an up key 18U, a down key 18D, a right key 18R, and a left key 18L. Keys 18 are preferably sealed pressure sensitive keys and may also be used to program and load the device.

The device 10 is used to provide alarm settings, shutdown settings where used, and other appropriate settings for the parameter being monitored and may also be utilized to select process operating modes, control the size of a deadband or to load other settings. An alarm setting is one which, if crossed, means that the system being monitored is outside of a desired range for the monitored parameter and corrective action should be taken. Such a detection for the preferred embodiment results in the operation of a switch which may control a valve, thermoelectric device, other heater/chiller or other appropriate control element for the system to bring the parameter back within an accepted range. A shutdown value is one which, if crossed, means that the system is in danger of failure, which in some instances can also represent a hazardous situation. This may require either an automatic shutdown of an affected portion of the monitored system or a failure alert to an operator to take appropriate remedial action.

Figure 2:
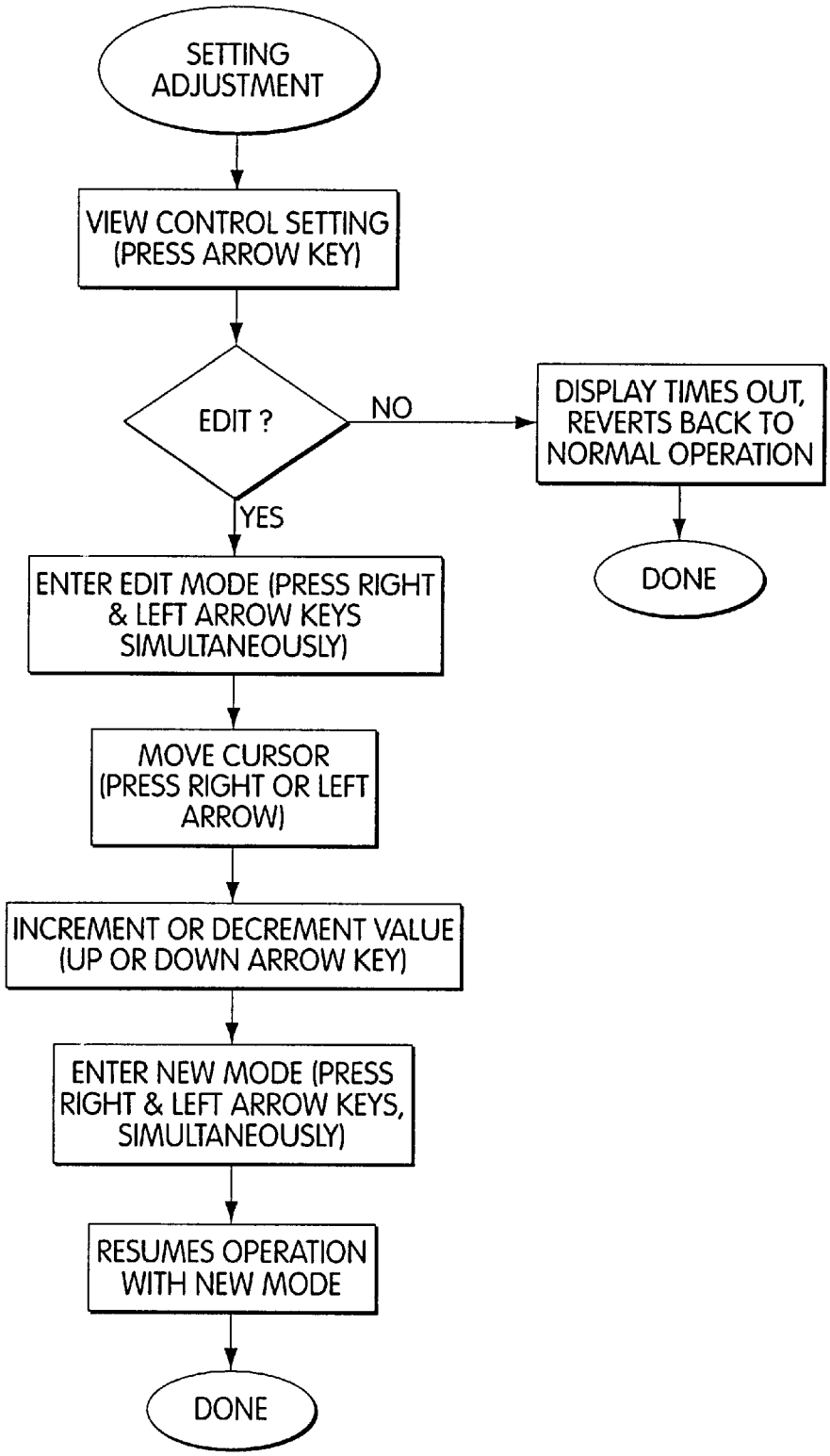
FIG. 2 and FIG. 3 are simplified flow diagrams suitable for use in loading various settings into the device shown in FIG. 1.
Figure 3:
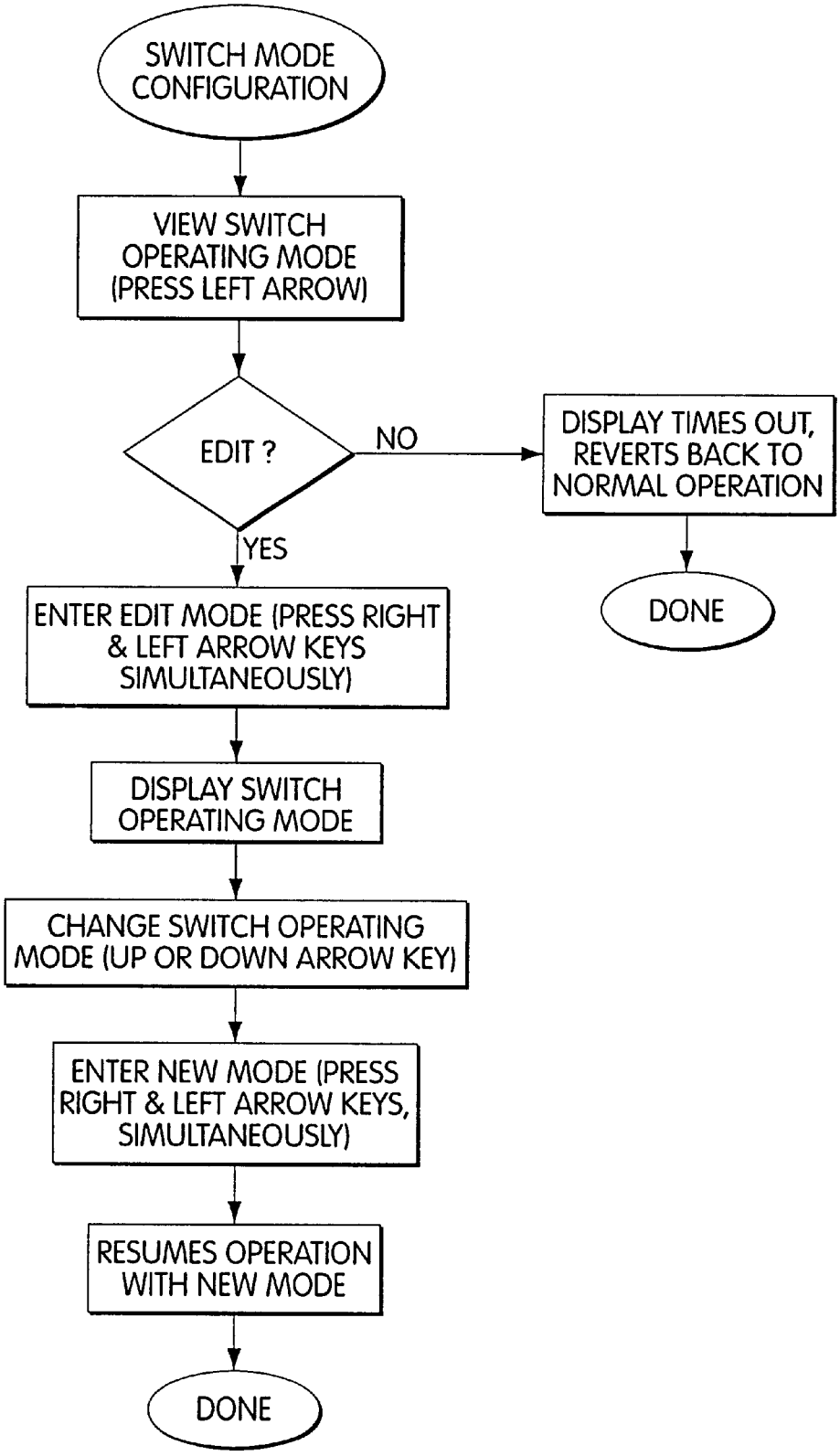
Figure 5:
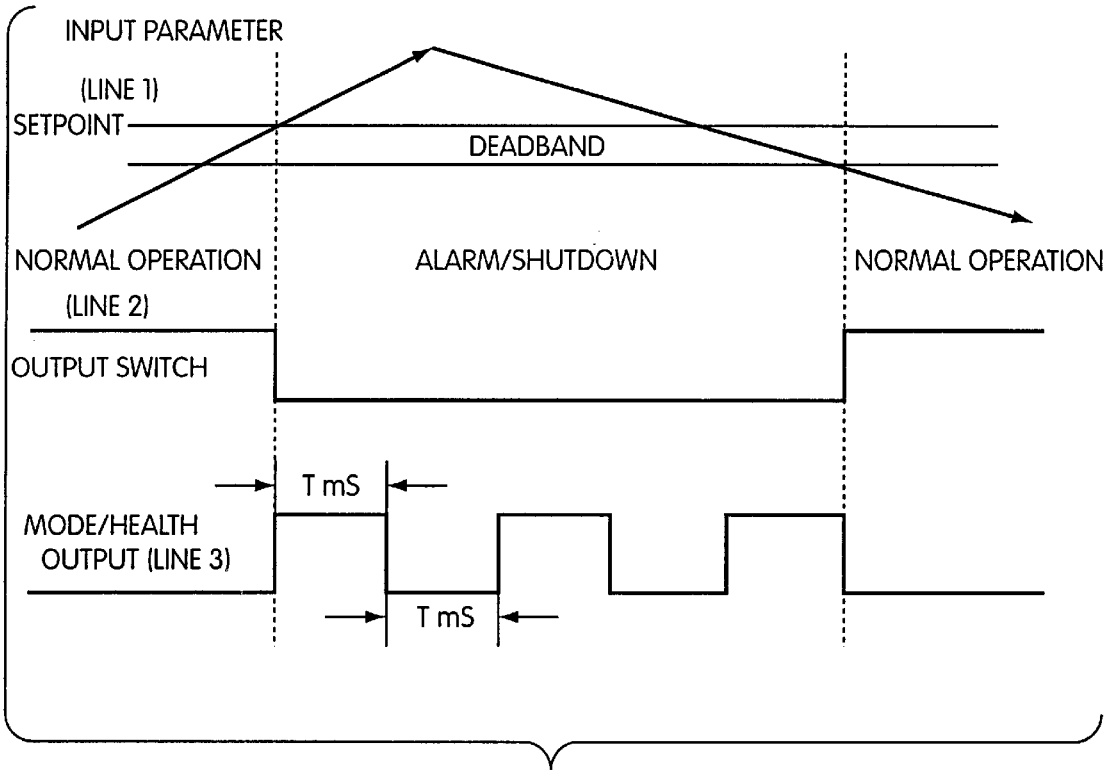
FIG. 5 is a diagram illustrating outputs from the device under various operating conditions.

Range limits for the sensor being used may also be loaded, with an overrange or underrange output being interpreted as an out of range site parameter or device failure. As illustrated in FIG. 5, and as will be discussed in greater detail later, a deadband may be provided of a size which may either be preset into device 10 or may be adjustable from I/O unit 16 or keys 18. The deadband assures that operation has moved well below the set point before the switch is opened and the alarm or shutdown mode terminated. This protects against the system toggling in and out of an alarm or shutdown mode as the monitored parameter hovers near the set point value. While the manner of setting various values into device 10 illustrated in FIGS. 2 and 3 is the currently preferred method for this invention if keys 18 are used, other techniques known in the art for loading values into a control device might also be employed, including the use of unit 16 which in some instances may provide greater flexibility.

Figure 4:
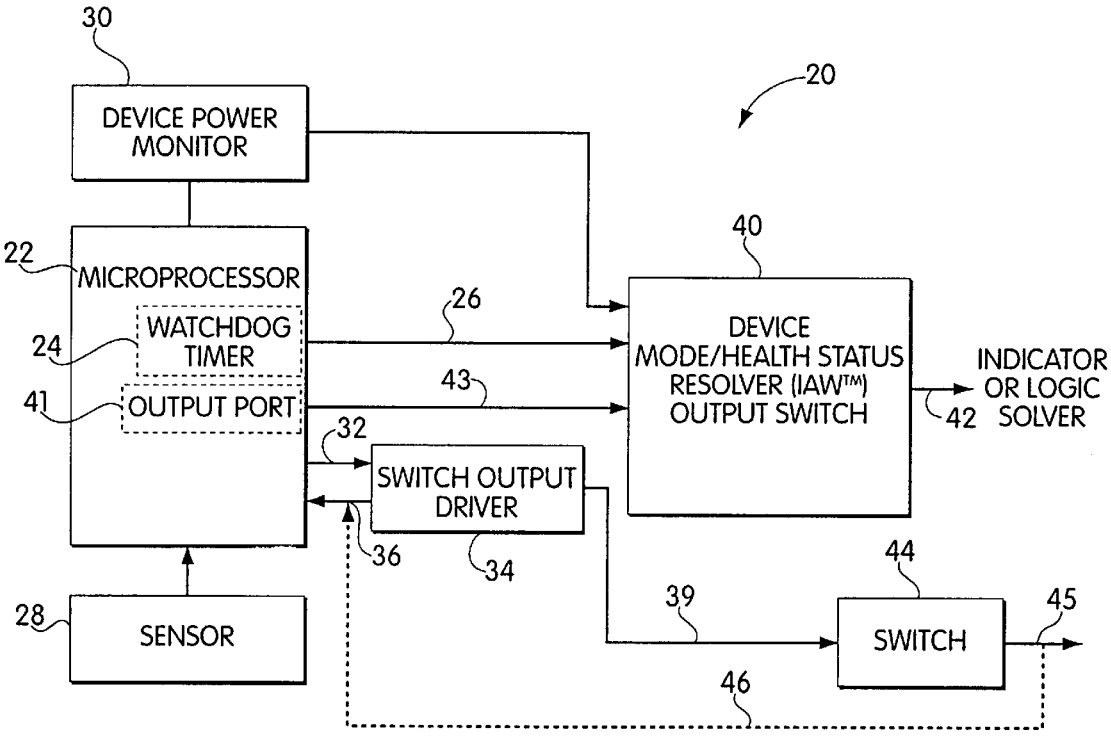
FIG. 4 is a simplified schematic block diagram of a circuit suitable for use in practicing the teachings of this invention.

FIG. 4 shows a circuit 20 which may be utilized to control device/mode health indicator 14 and, more important, to provide an output signal indicative of device mode and device "health" which may be used for control purposes and may also be fed to a remote monitoring/control station. The circuit 20 includes a microcontroller or microprocessor 22 having a watchdog timer 24. Watchdog timer 24 receives refresh inputs from microcontroller 22 at periodic intervals. So long as timer 24 receives refresh inputs, it continues to generate a pulsed output on line 26. However, if microcontroller 22 fails to provide a refresh input to timer 24, the timer times out, resulting in a zero or null output on line 26. Other methodology or embodiments may be implemented to achieve similar device health and integrity monitoring and indication.

Microcontroller 22 also receives inputs from sensor 28 which is connected through a suitable port to the site being monitored, and generates an output indicative of the present value for the parameter being monitored to an input port of microcontroller 22. Power is supplied to the microcontroller from a source 30 through another port, source 30 also providing power to other components in the device. The output from microcontroller 22 on line 32 is applied to an output switch driver 34 which loops the switch output signal back through a line 36 to an input port of the microcontroller and through line 39 to a control switch 44. Switch 44 controls an element (not shown) for restoring the sensed parameter to normal operations or alerting an operator of an abnormal condition. The output from resolver 40 on line 42

(which may for example be a twisted pair) is applied to the remote station where it is used for other control functions, including serving as an input to a processor at such station and either directly or through the processor to control a displays indicating the mode/health of the device 10.

In operation, so long as everything is working properly and monitored parameters have not exceeded alarm limits, microcontroller 22 generates a steady state output on line 43 which is applied to resolver 40. The microcontroller also provides refresh inputs to watchdog timer 24 so that the timer continues to generate an output on line 26. This pulsed output enables resolver 40 to pass the output on line 43 to device output line 42. At the remote facility, the steady state signal on line 42 may for example result in inputs to a processor and/or a lamp being continuously illuminated to signal that everything is normal at device 10.

If parameter values from sensor 28 move beyond an alarm limit set into microcontroller 22 in the manner previously indicated, the microcontroller recognizes this and changes the output on line 43 from a steady state output to a non-steady state output which, for preferred embodiments, is a series of pulses. This is illustrated in FIG. 5 where the pressure is indicated on line 1 as moving beyond a set point and the output on line 3 (i.e., the signal on line 43) is shown as going from a steady signal to a pulse signal. So long as watchdog timer 24 continues to generate a pulsed output on line 26, this output is also passed to line 42, causing an input to the remote station processor and for example a blinking or flashing of an indicator at the remote station which lets the operator know that device 10 is in an alarm mode, having exceeded its alarm limit and that its switch has been closed (line 2) to cause action to be taken to correct the alarm condition. The operator at the remote station may also take action, as appropriate, in response to this indication.

As illustrated in FIG. 5, there is a deadband value below the set point value so that the device does not go out of alarm mode when the pressure or other monitored parameter returns to the set point value, but only returns to normal mode operation when the parameter drops below the deadband value. Once reset occurs, the output on line 42 returns to the steady state condition. If there is a failure in microcontroller 22, the microcontroller will stop generating refresh signals to watchdog timer 24, resulting in the timer no longer providing a pulsed signal on line 26. The absence of a signal on line 26 prevents resolver 40 from passing signals received on line 43 to output line 42, resulting in a zero or null output to the remote station. This is detected at the remote station processor and may cause an indicator lamp at the control station for device 10 to turn off advising the operator at the station that there is a failure at device 10 which requires attention. The operator may alternatively be alerted in other ways. Depending on how critical conditions are at the site being monitored by device 10, a failure indication on line 42 may also cause an automatic shutdown in the affected area, or the operator may have the option of performing a selected shutdown or taking other appropriate remedial action.

If microcontroller 22 detects that the loop back signal on line 36 is different than the output sent out on line 32, or at least the output which should have been sent out on line 32, this could mean an error in output switch driver 34, line 39 or possibly the switch 44, a controller error, or some other problem, and is interpreted by the microcontroller as a device failure, resulting in a null output signal to port 41 and line 43. This results in a null output on lines 42 indicating a failure condition. Alternatively a signal loop back could be provided from the output line 45 of the switch 44 as indicated by the dashed line 46.

A failure condition can also be triggered in other ways depending on application. For example, if the parameter being monitored moves outside of the sensor range, this is detected by microcontroller 22 and again results in the microcontroller sending a null signal to port 41. This triggers other actions as previously discussed. It is also possible that either sensor 28 is malfunctioning or that the port used to connect sensor 28 to the site being monitored is plugged or otherwise obstructed. These and other failure conditions can be detected by storing at microcontroller 22 a profile of expected parameter variations with time. As indicated previously, parameters being monitored normally vary due to turbulence, variations in received power, ambient temperature or humidity, and the like. Thus, if no variation in the parameter is detected over a selected time period, which depending on application may vary from several minutes to several hours, this is an indication of a failure condition and can also be utilized to cause the microcontroller to send a null signal to port 41. While a parameter profile may be preset into microcontroller 22, the microcontroller can also operate in a "learn mode" wherein operation under normal conditions are monitored for selected time periods and utilized to create an application profile. This self learning mode could be used for, but is not limited to, learning the profile of a continuous or changing process. Microprocessor 22 could then use this self-learned profile to monitor parameters for acceptable and non-conforming performance and provide the appropriate status indication. An example might be to learn a parameter's profile conditions for day or evening process operation. Other variations from normal profile might also be utilized to cause a null output to port 41 and thus a null or failure indication on line 42. For example, the device might be able to identify abnormal signal excursions beyond upper or lower limits around a particular parameter profile and signal a fault condition. This could result from a signal slowly drifting out of range or a sudden step bias condition.

Figure 6:
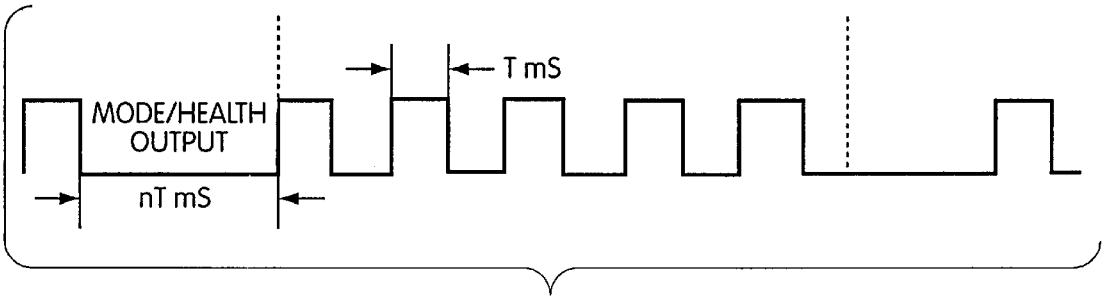
FIG. 6 is a diagram illustrating the mode/health line output for an alternative embodiment under various operating conditions.

While in the discussion above, a steady state output from the microcontroller appearing on line 42 has been utilized as an indication of normal operation, and a pulse output as an indication of alarm operation, and this is currently the preferred arrangement, it is also within the contemplation of the invention that the significance of these signals be reversed, or other frequency or duty cycle means of differentiation could be employed. For example, FIG. 6 indicates the outputs on line 42 for an alternative embodiment where the parameter being in the alarm range is still indicated by a pulse train having a duty cycle with the same on and off times, while the normal operating range is indicated by a pulse signal having for example the same on time duration as for the alarm range, but a longer duration between pulses, for example twice the duration between adjacent pulses. While in FIG. 6, the pulse frequency is shown as being twice that in FIG. 5 for the alarm range, this again is for purposes of illustration and the frequencies for both embodiments could be the same. Further, while in FIG. 6 the pulse on times have been maintained the same while the pulse off times have been increased for the normal mode as opposed to the alarm mode, this is by no means a limitation on the invention, and all that is required is that the pulse signals for these two different modes or ranges be identifiably different. Thus, the pulse signals for these two ranges could be of different frequency, could have different duty cycles, either pulse on times or pulse off times or some combination of both. Further, where pulse signals are being used for both the normal range and the alarm range, two different types of steady state signals could be used to indicate different types of failure modes, for example, a continuous on signal at a certain level indicating failure conditions such as short circuit, and a different steady state signal, for example a null signal, being indicative of open circuit or other failure conditions. Further, this embodiment could be expanded to include any number of steady state and/or non-steady state signals to indicate a wider variety of acceptable/normal, nonacceptable/alarm and failure conditions. The signal output could be an open collector output, being in the form of a voltage, current or impedance; an optical output (line 42) being a fiber optic line; or some other form of output on line 42 might be utilized for the various indications. A technique other than the use of a watchdog timer 24 or a null output to port 41 might also be utilized for generating the control signals to the resolver and an output control which functions somewhat differently from that described for resolver 40 might also be utilized. Similarly, the function of resolver 40 might be performed in microcontroller 22 or dedicated hardware components may be provided for performing all or any significant portion of the functions of microcontroller 22.

Thus, while the invention has been particularly shown and described above with reference to preferred embodiments, the foregoing and other changes in form and detail may be made therein by those skilled in the art without departing from the spirit and scope of the invention which is to be defined only by the appended claims.

What is claimed is:

1. A sensor device including:

a sensor for detecting a selected parameter at a site; and a controller for receiving indications from said sensor of said selected parameter, said controller generating one of a steady-state signal and a non-steady state signal when said parameter is within a first range, the other of said signals when said parameter is in a second range, and a null output in response to a failure condition at said device.

2. A sensor device as claimed in claim 1, including a deadband where said first and second ranges overlap, the controller continuing to generate the signal it is generating when in the deadband.

3. A sensor device as claimed in claim 1, wherein said controller includes a watchdog timer which continues to generate outputs only if it receives refresh inputs from the controller at selected time intervals, wherein said controller stops providing outputs to the watchdog timer in response to at least selected failure conditions at the device, and wherein said controller generates a null output when there is no output from the watchdog timer.

4. A sensor device as claimed in claim 3, wherein said controller stops providing inputs to the watchdog timer in response to at least one of a controller malfunction or a loss of power at the device.

5. A sensor device as claimed in claim 1, wherein said controller generates null outputs in response to selected failure conditions.

6. A sensor device as claimed in claim 5, wherein said parameter normally has at least slight variations with time, wherein said controller monitors variation in indications received from said sensor, and wherein said controller generates a null output in response to indications of the sensor not conforming to a predetermined profile.

7. A sensor device as claimed in claim 6, wherein said controller has a learn mode, the controller monitoring normal variations of the parameter when in learn mode to create said predetermined profile for the parameter.

8. A sensor device as claimed in claim 6, wherein said controller generates a null output in response to said indications from the sensor remaining substantially constant for a selected time interval.

9. A sensor device as claimed in claim 5, wherein said controller generates a null output in response to the parameter being out of the range of the sensor.

10. A sensor device as claimed in claim 1, wherein said controller drives a switch in response to said parameter being in a second range, wherein at least one of a drive signal from the controller for the switch and switch output is monitored, said controller generating a null output if the monitored drive signal/switch output is erroneous.

11. A sensor device as claimed in claim 1, including an output line from said device to which said signals and the null output are applied, said output line being connected to a remote monitoring station.

12. A sensor device including:

a sensor for detecting a selected parameter at a site, said parameter having at least one normal range, and at least one alarm range, and the device having at least one failure condition; and a controller for receiving indications from said sensor of said selected parameter, said controller generating a selected steady state signal when said parameter is within a selected one of said ranges, generating one of a second non-steady state signal and a second steady state signal when the parameter is in a second of said ranges, and generating a selected steady state signal in response to a selected failure condition at the device.

13. A sensor device as claimed in claim 12, wherein said controller generates said selected non-steady state signal when the parameter is in a said normal range and generates said second non-steady state signal when said parameter is in a said alarm range.

14. A sensor device as claimed in claim 13, wherein said device may have a plurality of failure conditions, and wherein said controller generates a steady state null output in response to at least selected failure conditions of the device.

15. A sensor device as claimed in claim 14, wherein said controller generates a steady state short output in response to selected failure conditions of the device for which a null output is not generated.

16. A sensor device as claimed in claim 12, wherein said controller generates said second steady state signal when said parameter is in a said normal range and generates said selected non-steady state signal when said parameter is in a said alarm range.

17. A sensor device as claimed in claim 12, including a deadband where a said normal range and a said alarm range overlap, the controller continuing to generate the signal it is generating when in the deadband.

18. A sensor device as claimed in claim 12, wherein said controller includes a watchdog timer which continues to generate outputs only if it receives refresh inputs from the controller at selected time intervals, wherein said controller stops providing outputs to the watchdog timer in response to at least selected failure conditions at the device, and wherein said controller generates a failure output when there is no output from the watchdog timer.

19. A sensor device as claimed in claim 12, wherein said parameter normally has at least slight variations with time, wherein said controller monitors variation in indications received from said sensor, and wherein said controller generates a failure output in response to indications of the sensor not conforming to a predetermined profile.

20. A sensor device as claimed in claim 19, wherein said controller has a learn mode, the controller monitoring normal variations of the parameter when in learn mode to create said predetermined profile for the parameter.

21. A sensor device as claimed in claim 19, wherein said controller generates a failure output in response to one of (a) said indications from the sensor remaining substantially constant for a selected time interval and (b) said indications exhibiting abnormal excursions beyond limits around said predetermined profile.

22. A sensor device as claimed in claim 12, wherein said controller drives a switch in response to said parameter being in an alarm range, wherein at least one of a drive signal from the controller for the switch and switch output is monitored, said controller generating a failure output if the monitored drive signal/switch output is erroneous.

* * * * *

UNITED STATES PATENT AND TRADEMARK OFFICE

CERTIFICATE OF CORRECTION

PATENT NO. : 6,339,373 B1 
DATED : January 15, 2002
INVENTOR(S) : Dale A. Zeskind, Dennis Lonigro and Donald Smith It is certified that error appears in the above-identified patent and that said Letters Patent is hereby corrected as shown below:

Column 8,
Line 23, please replace "steady" with -- non-steady --

Signed and Sealed this

Fifteenth Day of October, 2002

*Attest:*

*Attesting Officer*

JAMES E. ROGAN
*Director of the United States Patent and Trademark Office*